US007717070B2

(12) United States Patent
Kanig et al.

(10) Patent No.: US 7,717,070 B2
(45) Date of Patent: May 18, 2010

(54) OPTIMIZED COOLING SYSTEM FOR A MOTORIZED VEHICLE

(75) Inventors: Alexander Kanig, Wallertheim (DE); Torsten Löhnert, Liederbach (DE); Jörg Schieferstein, Trebur (DE)

(73) Assignee: GM Global Technology Operations, Inc., Detroit, MI (US)

( * ) Notice: Subject to any disclaimer, the term of this patent is extended or adjusted under 35 U.S.C. 154(b) by 230 days.

(21) Appl. No.: 11/569,219

(22) PCT Filed: May 18, 2005

(86) PCT No.: PCT/EP2005/005417

§ 371 (c)(1),
(2), (4) Date: Nov. 16, 2006

(87) PCT Pub. No.: WO2005/113959

PCT Pub. Date: Dec. 1, 2005

(65) Prior Publication Data

US 2007/0227474 A1 Oct. 4, 2007

(30) Foreign Application Priority Data

May 18, 2004 (DE) ..... 10 2004 024 516

(51) Int. Cl.
*F01P 11/08* (2006.01)

(52) U.S. Cl. ..... 123/41.33; 123/196 AB

(58) Field of Classification Search ..... 123/41.33, 123/196 AB

See application file for complete search history.

(56) References Cited

U.S. PATENT DOCUMENTS 2,067,421 A * 1/1937 Sergardi ..... 123/196 AB
2,365,166 A * 12/1944 Bay ..... 123/41.33
2,369,105 A * 2/1945 Ginn et al. ..... 123/41.33
2,392,723 A * 1/1946 Chandler ..... 123/41.08
5,477,817 A * 12/1995 Hufendiek et al. ..... 123/41.33
5,503,117 A 4/1996 Saito et al.
5,606,937 A * 3/1997 Calhoun ..... 123/41.33
5,647,306 A * 7/1997 Pateman ..... 123/41.33
5,758,608 A 6/1998 Berger et al.
6,053,131 A * 4/2000 Mueller et al. ..... 123/41.31
6,182,749 B1 * 2/2001 Brost et al. ..... 165/297
6,216,658 B1 * 4/2001 Pierro et al. ..... 123/193.2
6,360,702 B1 * 3/2002 Osada ..... 123/41.33
6,415,760 B2 * 7/2002 Mack et al. ..... 123/196 R
7,073,467 B2 * 7/2006 Kanno et al. ..... 123/41.33

FOREIGN PATENT DOCUMENTS

DE 7615571 U1 10/1976

(Continued)

*Primary Examiner*—Noah Kamen
(74) *Attorney, Agent, or Firm*—Ingrassia Fisher & Lorenz, P.C.

(57) ABSTRACT

The present invention provides engine-cooling module assemblies. One engine-cooling assembly includes an engine block and a cooling module including a coolant channel integrated into the engine block. Parallel to the coolant channel is a bypass channel integrated in the engine block and through which a portion of a coolant stream is conducted to an oil/coolant heat exchanger. The present invention also provides a method for cooling oil circulating in an oil circuit of an engine by means of a coolant. The coolant runs through a coolant channel that is formed of both a portion of the engine block and a portion of the cooling module.

10 Claims, 6 Drawing Sheets

FOREIGN PATENT DOCUMENTS

| | | | | |
|---|---|---|---|---|
| DE | 3608294 | A | * | 9/1987 |
| DE | 4322979 | A1 | | 1/1995 |
| DE | 19823254 | A1 | | 12/1999 |
| DE | 10241228 | A1 | | 3/2004 |
| EP | 0243138 | | | 10/1987 |
| EP | 0900924 | | | 3/1999 |
| EP | 0922849 | A2 | | 6/1999 |
| EP | 0926322 | A2 | | 6/1999 |
| EP | 1277932 | | * | 1/2003 |
| EP | 1411215 | | | 11/2006 |
| GB | 2309075 | A | * | 7/1997 |
| SU | 1716180 | A1 | * | 2/1992 |
| WO | WO 03106825 | A1 | * | 12/2003 |

* cited by examiner

OPTIMIZED COOLING SYSTEM FOR A MOTORIZED VEHICLE

CROSS-REFERENCE TO RELATED APPLICATIONS

This application is a U.S. National-Stage entry under 35 U.S.C. § 371 based on International Application No. PCT/EP2005/005417, filed May 18, 2005, which was published under PCT Article 21(2) and which claims priority to German Application No. DE 10 2004 024 516.9, filed May 18, 2004.

FIELD OF THE INVENTION

The present invention pertains to the field of cooling systems, and more particularly relates to automotive cooling systems.

BACKGROUND

Presently, known cooling devices and processes for cooling an internal-combustion engine of a motor vehicle employ oil cooled by means of a coolant. There are various kinds of cooling devices which are differentiated in regard to the coolant. One cooling device in accordance with the prior art is the air-oil cooler. This is arranged at the front of the motor vehicle in the air flow produced by the movement of the vehicle.

The disadvantage of this solution is that the coolant being used—the air—has a relatively low heat transmission coefficient. In order to implement an adequate oil-cooling system, an air-oil cooler of relatively large construction is therefore necessary. In addition, the cooling process is dependent on the air flow and thus on the speed at which the motor vehicle is travelling. At low speeds of travel, the air-oil cooler does not provide sufficient cooling power. The oil must be fed to the air-oil cooler. To this end, flexible lines from the engine to the air-oil cooler have to be employed due to the distances that have to be bridged and the flexible path required for the conveyance of the oil. These flexible lines, which are usually in the form of hoses, are inclined to leak after a long period of use.

Another cooling device in accordance with the prior art is the oil-water heat exchanger. This uses water or cooling water as the cooling medium. Due to the higher heat transmission coefficient of water, this heat exchanger has greater cooling power while occupying lesser space. The coolant, more precisely, the water, and the oil are fed through a line system consisting of hoses or pipes. The use of pipes and hoses is disadvantageous in regard to the interconnections of the pipes and hoses or the connections thereof to the engine or the oil-water heat exchanger since the connections tend to leak relatively quickly, particularly at the junction points. Furthermore, the mechanical flow properties of the connections are disadvantageous since the connections lead in part to large resistances in the line system.

A third cooling device in accordance with the prior art is the oil-water heat exchanger module with an oil filter. This solution overcomes some of the disadvantages of the previously-specified cooling devices. The advantage of the modular construction is that the oil-water heat exchanger module is of compact construction. The oil filter is in the form of a filter cartridge which is flanged on the heat exchanger. The oil line system is in the form of a channel integrated into the module housing, whereby the risk of leakage from the oil line is significantly reduced.

The disadvantage of this solution is that, here too, the coolant in the form of water is fed and guided through hoses.

Consequently, leakage from the water pipeline may continue to occur. In addition, vibratory problems may occur during the operation of the motor vehicle due to the heavy concentration of components within a small constructional space, and these can lead to the failure of the cooling device in some circumstances.

In all of the solutions specified above, the current-flow of the media—coolants/oil—flowing in the channels is effected in succession, i.e. in a kind of series circuit. The channels are thereby of greater length; this thus leads to a larger constructional volume. In addition, the line system is of greater total resistance due to the length of the channels, so that this too has to be compensated for by a larger dimensioning of the flow-path cross-sections of the line system if there is to be no loss of performance. However, apart from the cooling function thereof, a goal of such cooling systems is to maintain the pressure difference in the cooling module as low as possible since this itself adds to the overall drop in pressure through the entire engine system and a decrease in pressure represents a loss of effectiveness. The greater the decrease in pressure, the higher the loss of effectiveness. In order to ensure this in the conventional systems, the cooling medium flows through the cooling module at high speed, i.e. it spends a lesser period of time in the cooler module or cooler package, whereby the cooling medium can absorb and remove only a little of the heat energy and this thus results in a less effective cooling process. In addition, due to the serial arrangement, the water circulation systems in the cylinder block and in the cylinder head must be adjusted separately, i.e. it is necessary for the circulation of the water in the cylinder block and the cylinder head to be readjusted. Additional expenditure on the adjustment process thereby arises.

BRIEF SUMMARY OF THE INVENTION

An object of the present invention is to provide a cooling system and a cooling process with the aid of which efficient cooling of a circulating oil is realized while optimally utilizing the constructional space.

The present invention relates to a cooler module for cooling an oil that is circulating in an oil-circulating system of an engine by means of a coolant comprising a housing, an oil-coolant heat exchanger, an oil filter and at least one module coolant channel for transporting the coolant which runs through the module housing and connects the oil-coolant heat exchanger and the oil filter in fluidic manner. Furthermore, the invention relates to an engine coolant channel running in an engine block for cooling an oil that is circulating in an oil-circulating system of an engine by means of a coolant comprising an engine block housing and at least one engine coolant channel for transporting the coolant running therethrough, an engine cooler module arrangement for cooling an oil that is circulating in an oil-circulating system of an engine by means of a coolant comprising an engine having an engine block and a cooler module connected to the engine block, wherein the cooler module is connected to the engine block in such a manner that the channels running in the engine and the channels running in the module are connected together in fluidic manner in order to form a closed cooling pipeline system. Finally, the invention also relates to a cooling process for cooling an oil-circulating system of an engine by means of a coolant flowing through an oil-coolant heat exchanger in a coolant-circulating system formed from channels comprising an engine block and/or a cooler module comprising the steps of feeding the coolant through a first section of the coolant-circulating system which runs through the engine block, passing the coolant on through a second section of the coolant-circulating system which runs through the oil-coolant heat exchanger, and closing the coolant-circulating system.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Figure 1:
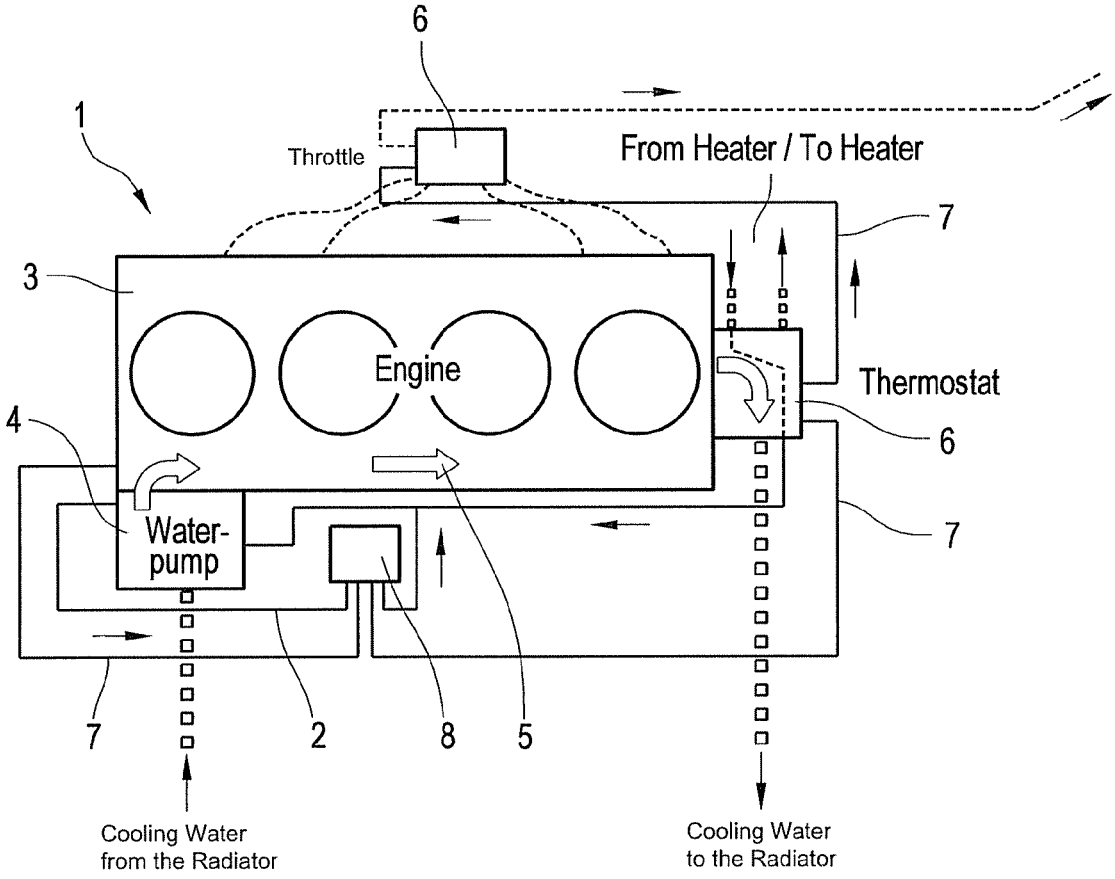
FIG. 1 illustrates a schematic illustration of an engine including a bypass channel in accordance with the invention.

FIG. 1 illustrates a schematic engine cooler module arrangement 1 or an engine incorporating an integrated bypass channel 2. The engine cooler module arrangement 1 or the engine comprises a bypass channel 2 for transporting cooling water. Furthermore, the engine comprises an engine block 3 and a water pump 4. An engine coolant channel 5 for transporting cooling water is formed in the engine block 3 (illustrated schematically here by white arrows). In FIG. 1, the bypass channel 2 and the engine coolant channel 5 are supplied with cooling water via the water pump 4. Consequently, the cooling water is divided into two partial streams at the water pump 4. A partial stream of cooling water flows through the engine coolant channel 5 and the other partial stream flows through the bypass channel 2. Both partial streams flow through a common channel section back to the water pump 4. The water pump 4 itself is supplied with cooled cooling water by a (not illustrated) radiator (illustrated by a dotted line). A regulating unit 6 in the form of a thermostat is connected in the cooling water circulating system. This causes the cooling water that is no longer being used for the cooling process to flow off to the radiator (illustrated by a dotted line). The oil-circulating system is only partially illustrated in FIG. 1. The oil flows via an oil channel 7 through a regulating unit 6 in the form of a valve to the regulating unit 6 in the form of a thermostat. From there, the oil flows on into the oil-coolant heat exchanger 8 where it is cooled by the stream of cooling water which is likewise flowing through the oil-coolant heat exchanger 8. The bypass channel 2 can be integrated in the engine block 3 or else be connected to the engine separately integrated in a cooler module that is illustrated in FIG. 2.

Figure 2:
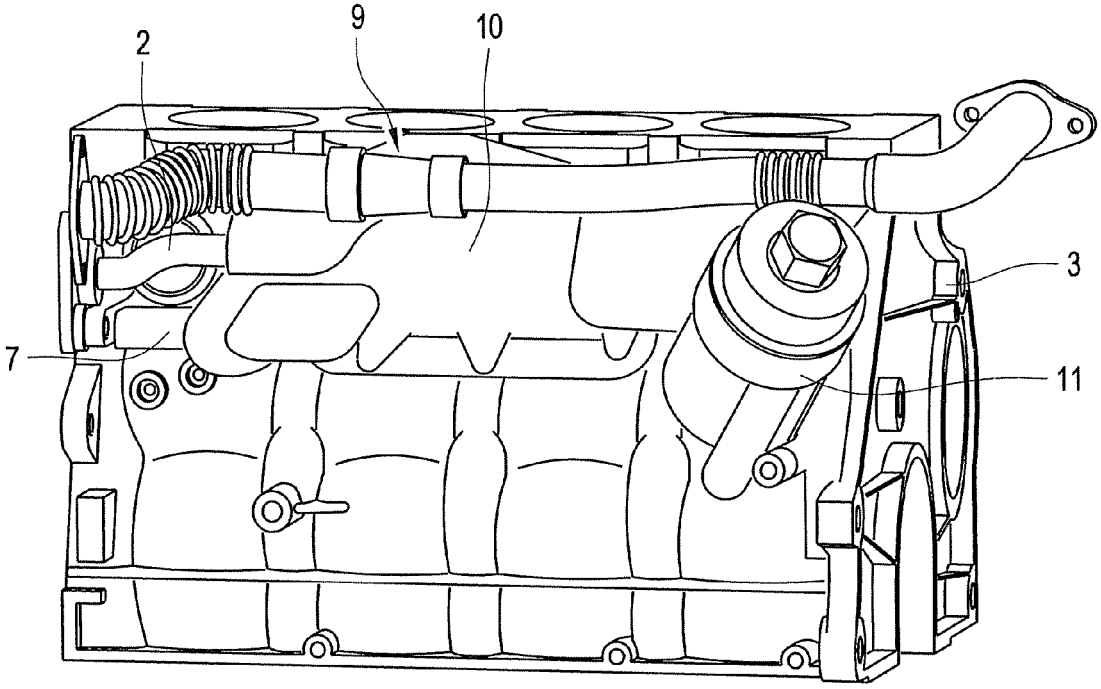
FIG. 2 illustrates a partial sectional view of an engine cooler module arrangement in the form of a perspective view as seen from the front of the engine.

FIG. 2 illustrates a partial sectional view of an engine cooler module arrangement 1 comprising a cooler module 9 which is attached to an engine—more precisely, to an engine block 3—by means of a bolted connection. The cooler module 9 comprises a module housing 10 in which the bypass channel 2 (not visible here) and the oil channel 7 run. An oil filter 11 is integrated into the cooler module 9. This is in the form of a kind of cartridge. The cooler module 9 is illustrated in FIG. 3 as seen from the engine side.

Figure 3:
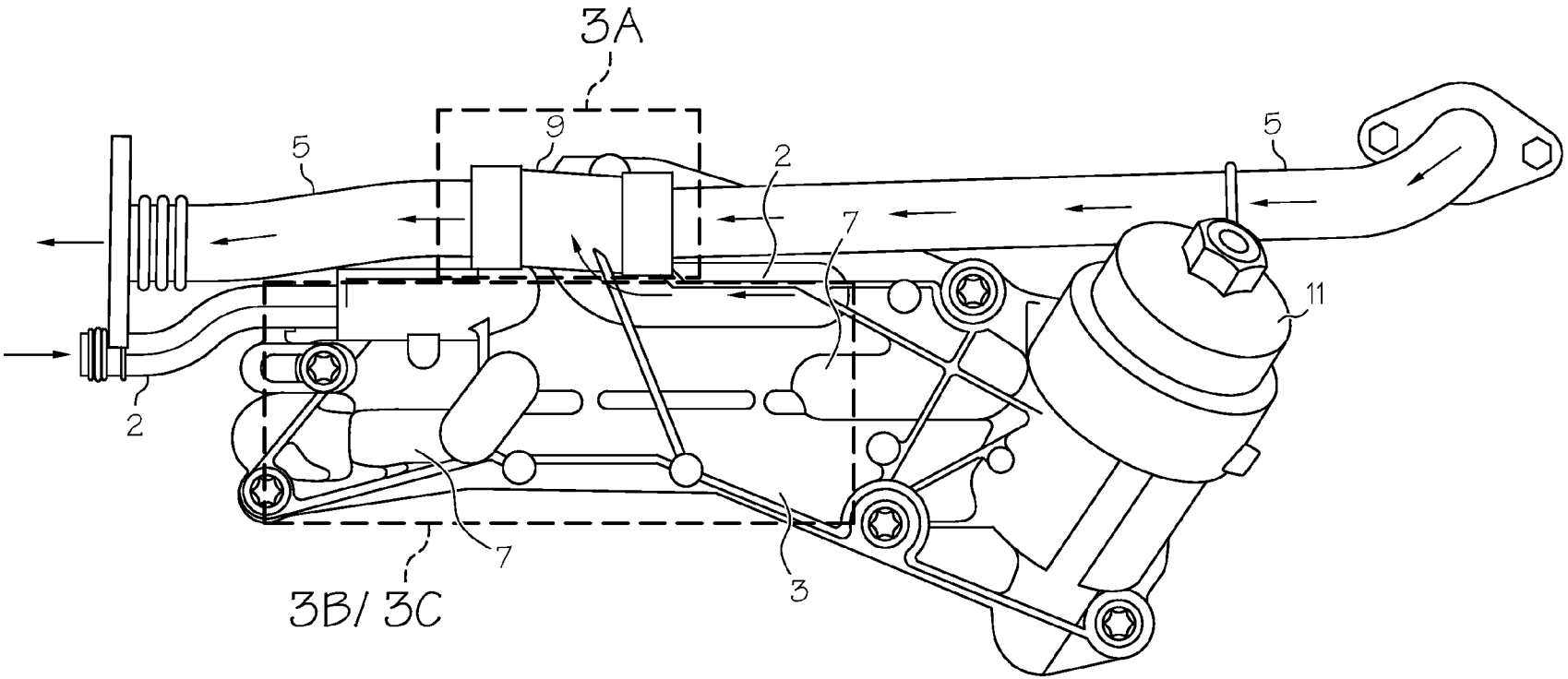
FIGS. 3-3*c* illustrate various views of a cooler module.

FIG. 3 illustrates the cooler module 9. The cooler module 9 comprises an oil filter 11 and a housing in which the bypass channel 2 and the oil channel 7 are arranged. A partial channel section 5 for diverting the coolant or the oil is arranged on the housing.

Figure 3A:
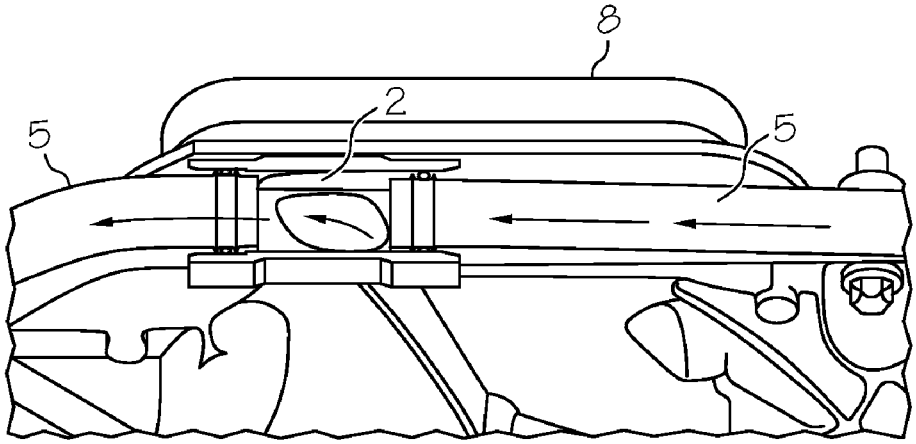
Figure 3B:
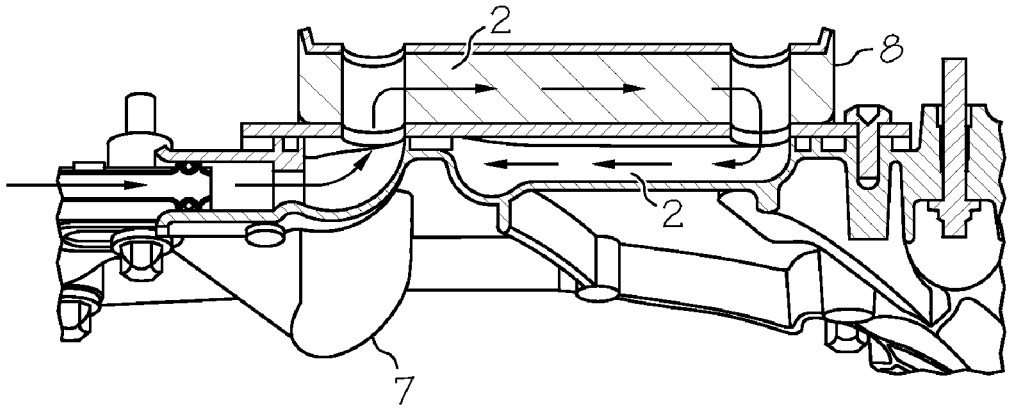
Figure 3C:
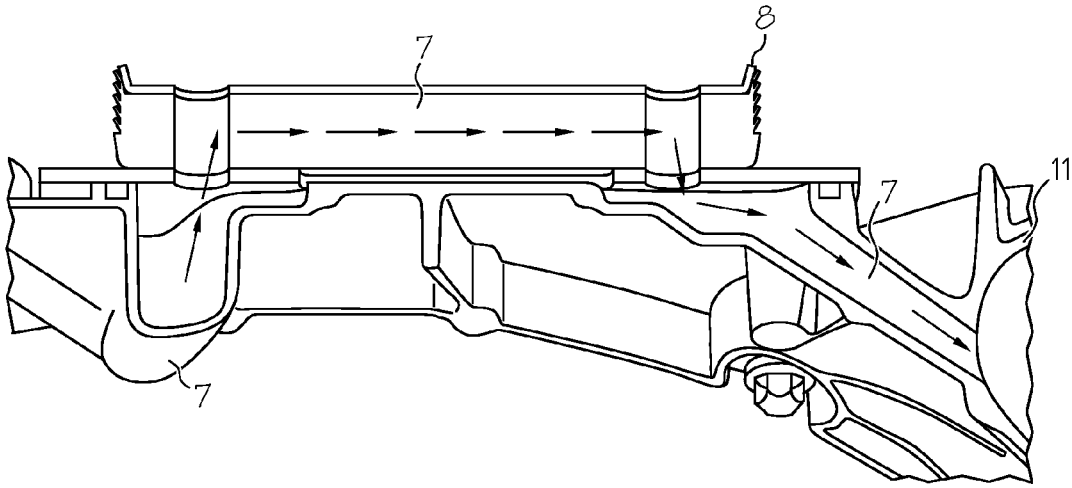

FIG. 3A illustrates the flow of coolant through a portion 3A of FIG. 3 including an opening to the bypass channel 2, the partial channel section 5, and the oil-coolant heat exchanger 8. FIG. 3B illustrates the flow of coolant through a portion 3B of FIG. 3 including the bypass channel 2. FIG. 3C illustrates the flow of oil through a portion 3C of FIG. 3 including the oil channel 7 and the oil filter 11.

Figure 4:
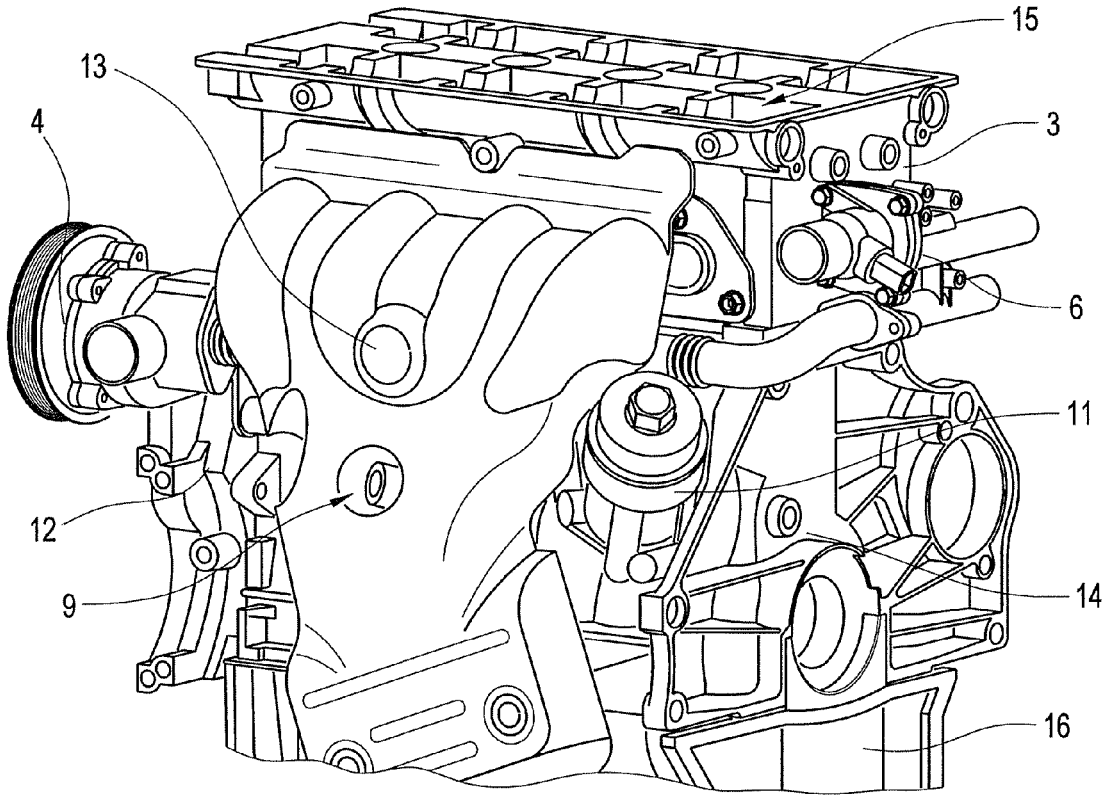
FIG. 4 illustrates an engine cooler module arrangement in the form of a perspective view from the front.

FIG. 4 illustrates an engine cooler module arrangement including a cooler module 9 which is integrated in an engine. The engine in FIG. 4 comprises an engine block 3, a water pump 4, a cover 12, a manifold with heat shield 13, a cylinder block 14 having a cylinder head 15 and an oil sump 16. The cooler module 9 is, to a large extent, integrated into the engine, whereby only the oil filter 11 and parts of the channels protrude from the engine.

The invention includes the technical teaching that the module coolant channel formed in the housing of the cooler module is at least partially in the form of a bypass channel to the engine coolant channel which is connected in fluidic manner to the oil-coolant heat exchanger in order to divide the coolant stream into two partial streams and thus produce a parallel connection of the coolant streams.

Thereby, the module coolant channel may comprise an additional bypass channel in at least one section thereof or it may be formed in its entirety as a bypass channel. The branching of the bypass channel can be effected from a section of the engine coolant channel that is formed in the engine block or be branched off directly from the water pump.

Apart from the cooling unit for cooling the oil being in the form of an oil-coolant heat exchanger, any other cooling unit that is suitable for cooling oil could also be used.

This solution offers the advantage that the overall length of the pipeline system is shortened due to the bypass channel and the parallel connection of the coolant associated therewith. The coolant used for the cooling process no longer just passes through the heat-emitting engine and is then supplied to the heat exchanger, but rather it is supplied to the heat exchanger in parallel with its passage through the engine. In consequence, the temperature of the coolant is significantly lower upon its entry into the heat exchanger whereby a significant improvement of the cooling effect in the heat exchanger is obtained. Water is preferably used as the coolant. The coolant circulating system can therefore be connected directly to the internal water circulating system. The water is preferably extracted directly behind the water pump. It is therefore advantageous that the bypass channel be arranged as close to the water pump as possible. Consequently, the water is only heated up a little due to the heat that has been transferred from the engine to the cooling water so that a relatively low water temperature is realized when the water runs into the heat exchanger. In consequence, the temperature difference between the incoming cooling water and the oil that requires cooling is greater than that in the conventional solutions so that the cooling effect is significantly improved.

In contrast to the conventional cooling systems, the system for the circulation of the water in the heat exchanger is connected in parallel with that for the circulation of the water through the engine block. This means that here, in contrast to the conventional cooling systems, a high difference of pressure is required in order not to have an effect upon the water circulating system for the engine. As a result of the large difference in pressure, the coolant spends a longer period of time in the cooler package or cooler module, whereby a larger amount of heat can be absorbed by the coolant or the cooling medium and hence a more effective cooling effect is realizable. Due to the improvement in the amount of heat being absorbed in comparison with conventional cooling systems for the same cooling performance, fewer cooling plates are needed in the cooler module. Constructional space can thus be saved. Thus, overall, there is also an increase in the cooling efficiency and a concomitant reduction in cost as a result of the invention.

A further measure for improving the invention envisages that the module coolant channel be formed such as to be connected in releasable and fluidic manner to a corresponding engine coolant channel in order to lead the coolant stream flowing through an engine block of the engine through the cooler module. In this way, a portion of the previously existing engine coolant channel can be used for transporting the cooling water. The cooling water is then led through the module to the heat exchanger in the region in which the heat exchanger is arranged. An external hose line can thus be dispensed with since the engine channel and the bypass channel are each integrated into the module housing. The heat exchanger is preferably arranged in the direct proximity of the engine, whereby the length of the bypass channel is relatively short and a compact engine cooling module arrangement is possible.

It is advantageous for the bypass channel to transport a partial stream of the coolant to the oil cooler arranged on the housing and to then transport it away therefrom. The oil cooler is arranged on the cooler module. A partial stream is fed off through the bypass channel due to the parallel connection of the coolant flow. This partial stream is fed to the oil cooler. Smaller flow cross-sections can be used in the channels due to the partial stream being fed off.

The coolant is preferably in the form of cooling water. This can be branched off from previously existing cooling water lines without the need to provide an additional coolant circulating system with an additional coolant for feeding the coolant circulating system.

A measure which particularly improves the invention provides for the oil-coolant heat exchanger to be at least partially integrated into the module housing. A very compact cooler module having a short channel length is realized in this way. The compact module can be installed and handled easily without any great effort. Due to the at least partial integration of the heat exchanger into the cooler module, a more secure and reliable mounting is ensured, this thereby ensuring an improved vibratory response of the module.

Preferably, the module housing comprises at least one integrated oil channel for feeding the oil to and from the oil-coolant heat exchanger and/or the oil filter. Due to the fact that the oil channel is also integrated into the housing, external lines are no longer needed thereby reducing the risk of leakages still more.

Furthermore, the invention includes the technical teaching that there is provided an engine block for cooling an oil circulating in an oil-circulating system of an engine by means of a coolant comprising at least one integrated engine coolant channel for transporting the coolant, wherein at least one section of the engine coolant channel comprises a bypass channel which is connected in fluidic manner to the oil-coolant heat exchanger in order to transport or feed one of the two parallel connected partial coolant streams to the oil-coolant heat exchanger and away therefrom. The bypass channel should branch off as closely as possible to the coolant cooling means of the engine coolant channel in order to branch off coolant at as low a temperature as possible.

This solution offers the advantage that the bypass channel is formed directly in the engine block or in the engine block housing so that one can dispense with an additional module. Thus, overall, fewer components are needed.

Furthermore, the invention includes the technical teaching that an engine cooler module arrangement for cooling an oil that is circulating in an oil-circulating system of an engine by means of a coolant comprising an engine including an engine block, comprises at least one engine coolant channel integrated into the engine block and a cooler module connected in fluidic manner to the engine block, wherein the cooler module is connected to the engine block in such a manner that the at least one engine coolant channel and the at least one module coolant channel or the engine coolant channels and the module coolant channels are connected together in fluidic manner in order to form a closed coolant line system.

In contrast to the previously specified one-piece solution including an engine block which comprises an integrated bypass channel, the embodiment specified here is formed from two parts, i.e. an engine and a cooler module. The engine block or the engine block housing can be manufactured with lesser expenditure. In addition, the cooler module can be integrated into the engine block, whereby the cooler module or the channels formed in the cooler module replaces a portion of the channels that are otherwise found in the engine block. In this way, the constructional space occupied by the engine cooler module arrangement can be reduced still further thereby providing additional constructional space. An oil-coolant heat exchanger in the form of a cooling plate package through which the oil flows can be arranged in this additional space for example.

For this reason, it is advantageous for the cooler module to be formed such that it is at least partially integrated into the engine block so that at least one portion of the cooler module is integrated into the engine block so that the at least one engine coolant channel is at least partially replaceable by the module coolant channel and/or the bypass channel. A reliable and secure mounting of the module is ensured by virtue of the at least partial integration of the cooler module into the engine block. An engine cooling module arrangement that is optimised in regard to the vibratory response thereof is realized by this arrangement. The cooler module vibrates less due to the partial integration thereof so that damage or functional impairment due to vibration is prevented insofar as possible.

Another measure for improving the invention still more envisages that at least one regulating unit for regulating the oil flow be additionally formed in the oil-circulating system. The quantity of oil flowing through the oil channel can thus be controlled in dependence on the particular requirements and the type of application.

The invention also includes the technical teaching that there is provided a cooling process for cooling an oil-circulating system of an engine by means of a coolant flowing through an oil-coolant heat exchanger in a coolant-circulating system formed of channels and comprising an engine block and/or a cooler module, which comprises the steps of: feeding the coolant stream through a first section of the coolant-circulating system which runs through the engine block, passing the coolant stream on through a second section of the coolant-circulating system which runs through the oil-cooler, and closing the coolant-circulating system, wherein the steps of feeding the coolant through a first section and passing the coolant on through a second section take place in parallel.

There is a significant improvement in the effectiveness of the cooling process as a result of the parallel connection, whereby the heat exchanger is adapted to be dimensioned with smaller dimensions so that this effective cooling process is also utilisable in motor vehicles of lesser space, in particular, in small cars.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

The invention claimed is:

1. A cooler module for cooling oil that is circulating in an oil-circulating system of an engine by means of a coolant stream flowing through an engine coolant channel comprising:

an engine block;

a module housing covering a portion of the engine block;

an oil-coolant heat exchanger connected to the module housing; and an oil filter connected to the module housing, wherein:

a portion of the module housing and a portion of the engine block form at least one module coolant channel for transporting coolant through the engine to the oil-coolant heat exchanger and to the oil filter, the module coolant channel is at least partially in the form of a channel section of the engine coolant channel and partially in the form of a bypass channel to the engine coolant channel or to the module coolant channel, and the module coolant channel is in fluid communication with the oil-coolant heat exchanger to divide the coolant stream into two partial coolant streams to produce a parallel connection of the two partial coolant streams.

2. A cooler module in accordance with claim 1, wherein the module coolant channel is configured to be releasable with and in fluid communication with a corresponding engine coolant channel of the engine to lead the coolant stream flowing through an engine block of the engine through the cooler module.

3. A cooler module in accordance with claim 1, wherein the coolant is cooling water.

4. A cooler module in accordance with claim 1, wherein the oil-coolant heat exchanger is at least partially integrated in the module housing.

5. A cooler module in accordance with claim 4, wherein the module housing comprises at least one integrated oil channel for feeding the oil to and from the oil-coolant heat exchanger, the oil filter, or both.

6. An engine, comprising:

an oil-coolant heat exchanger;

an engine block configured to cool an oil that is circulating the engine via a stream of coolant; and a module housing covering a portion of the engine block, wherein:

a portion of the module housing and a portion of the engine block form at least one integrated engine coolant channel for transporting the stream of coolant through the engine, and at least one section of the integrated engine coolant channel comprises an integrated bypass channel that is in fluid communication with the oil-coolant heat exchanger to feed one of two parallel connected partial coolant streams to the oil-coolant heat exchanger and away therefrom.

7. An engine cooler module arrangement for cooling an oil that is circulating in an oil-circulating system of an engine by means of a coolant comprising:

an engine including an engine block;

a module housing covering a portion of the engine block, wherein:

a portion of the module housing and a portion of the engine block form at least one module coolant channel for transporting the coolant through the engine; and at least one engine coolant channel integrated into the engine block and in fluid communication with the at least one module coolant channel to form a closed coolant pipeline system.

8. An engine cooler module arrangement in accordance with claim 7, wherein at least one portion of the cooler module is integrated into the engine block so that the at least one engine coolant channel is at least partially replaceable by the module coolant channel.

9. An engine cooler module arrangement in accordance with claim 7, wherein the oil-circulating system comprises at least one regulating unit for regulating the oil flow.

10. A cooling process for cooling an oil that is circulating in an oil-circulating system of an engine by means of a stream of coolant flowing through an oil-coolant heat exchanger in a coolant-circulating system formed of channels or pipelines and comprising an engine block or a cooler module, comprising the steps of:

feeding the coolant stream through a first section of the coolant-circulating system that runs through the engine block, the first section comprising a module housing covering a portion of the engine block such that a portion of the module housing and a portion of the engine block form at least one integrated engine coolant channel for transporting the coolant stream;

passing the coolant stream through a second section of the coolant-circulating system that runs through the oil-coolant heat exchanger; and closing the coolant-circulating system to realize a closed coolant-circulating system, wherein the steps of feeding the coolant stream through the first section and passing the coolant stream through the second section take place in parallel and in a same component.

* * * * *